US010937578B2

(12) United States Patent
Ohashi et al.

(10) Patent No.: US 10,937,578 B2
(45) Date of Patent: Mar. 2, 2021

(54) METHOD FOR PREPARING R—FE—B SINTERED MAGNET

(71) Applicant: Shin-Etsu Chemical Co., Ltd., Tokyo (JP)

(72) Inventors: Tetsuya Ohashi, Echizen (JP); Tetsuya Kume, Echizen (JP); Koichi Hirota, Echizen (JP); Hajime Nakamura, Echizen (JP)

(73) Assignee: Shin-Etsu Chemical Co., Ltd., Tokyo (JP)

( * ) Notice: Subject to any disclaimer, the term of this patent is extended or adjusted under 35 U.S.C. 154(b) by 84 days.

(21) Appl. No.: 15/710,341

(22) Filed: Sep. 20, 2017

(65) Prior Publication Data

US 2018/0090249 A1 Mar. 29, 2018

(30) Foreign Application Priority Data

Sep. 26, 2016 (JP) ..... JP2016-187177

(51) Int. Cl.
*H01F 1/057* (2006.01)
*H01F 41/02* (2006.01)
(Continued)

(52) U.S. Cl.
CPC ..... *H01F 1/0577* (2013.01); *B22F 3/16* (2013.01); *B22F 3/24* (2013.01); *H01F 41/0293* (2013.01);
(Continued)

(58) Field of Classification Search
CPC ..... H01F 1/0577; H01F 41/0293; H01F 41/0266; B22F 3/24
See application file for complete search history.

(56) References Cited

U.S. PATENT DOCUMENTS 4,826,546 A * 5/1989 Yamamoto ..... B22F 3/24 148/102
7,090,730 B2 8/2006 Nomura et al.
(Continued)

FOREIGN PATENT DOCUMENTS

CN 105960690 A 9/2016
DE 19945942 A1 4/2001
(Continued)

OTHER PUBLICATIONS

KR-20100097580-A machine translation (Year: 2010).*
(Continued)

*Primary Examiner* — Colleen P Dunn
*Assistant Examiner* — Sean P. O'Keefe
(74) *Attorney, Agent, or Firm* — Westerman, Hattori, Daniels & Adrian, LLP

(57) ABSTRACT

An R—Fe—B base sintered magnet is prepared through the steps of providing an alloy fine powder having a predetermined composition, compression shaping the alloy fine powder in an applied magnetic field into a compact, sintering the compact at a temperature of 900-1,250° C. into a sintered body, cooling the sintered body to 400° C. or below, high-temperature heat treatment including placing a metal, compound or intermetallic compound containing HR which is Dy, Tb and/or Ho, on the surface of the sintered body, heating at a temperature from more than 950° C. to 1,100° C., for causing grain boundary diffusion of HR into the sintered body, and cooling to 400° C. or below, and low-temperature heat treatment including heating at a temperature of 400-600° C. and cooling to 300° C. or below. The sintered magnet produces a high coercivity despite a low content of Dy, Tb and Ho.

26 Claims, 2 Drawing Sheets

(51) Int. Cl.
*B22F 3/16* (2006.01)
*B22F 3/24* (2006.01)
*C22C 38/00* (2006.01)

(52) U.S. Cl.
CPC ..... *B22F 2003/248* (2013.01); *C22C 38/005* (2013.01)

(56) References Cited

U.S. PATENT DOCUMENTS

| | | | | |
|---|---|---|---|---|
| 9,892,831 | B2 * | 2/2018 | Hirota | H01F 41/0266 |
| 10,410,775 | B2 * | 9/2019 | Hirota | B22F 3/24 |
| 2004/0094237 | A1 | 5/2004 | Nomura et al. | |
| 2010/0182113 | A1 | 7/2010 | Yoshimura et al. | |
| 2011/0000586 | A1 | 1/2011 | Nomura et al. | |
| 2012/0235778 | A1 * | 9/2012 | Kunieda | H01F 1/0577 335/302 |
| 2013/0009503 | A1 * | 1/2013 | Iwasaki | C21D 6/00 310/152 |
| 2013/0293328 | A1 | 11/2013 | Kuniyoshi | |
| 2014/0132377 | A1 | 5/2014 | Nakajima et al. | |
| 2014/0191831 | A1 | 7/2014 | Yamazaki et al. | |
| 2014/0290803 | A1 | 10/2014 | Kato et al. | |
| 2016/0042848 | A1 | 2/2016 | Kuniyoshi et al. | |
| 2016/0293304 | A1 | 10/2016 | Hirota et al. | |
| 2016/0293307 | A1 | 10/2016 | Hirota et al. | |
| 2016/0300648 | A1 | 10/2016 | Nagata et al. | |
| 2017/0018342 | A1 * | 1/2017 | Fukagawa | C22C 38/10 |
| 2017/0140856 | A1 | 5/2017 | Hirota et al. | |
| 2017/0256344 | A1 | 9/2017 | Satoh et al. | |
| 2017/0365384 | A1 * | 12/2017 | Hirota | H01F 1/059 |
| 2018/0090249 | A1 | 3/2018 | Ohashi et al. | |
| 2018/0090250 | A1 | 3/2018 | Ohashi et al. | |

FOREIGN PATENT DOCUMENTS

| | | | |
|---|---|---|---|
| EP | 0945878 | A1 | 9/1999 |
| EP | 1 214 720 | A1 | 6/2002 |
| EP | 1 420 418 | A1 | 5/2004 |
| EP | 2500915 | A1 | 9/2012 |
| EP | 2 555 208 | A1 | 2/2013 |
| EP | 2590181 | A1 | 5/2013 |
| JP | 07-240308 | A | 9/1995 |
| JP | 2003-510467 | A | 3/2003 |
| JP | 3997413 | B2 | 10/2007 |
| JP | 2011-211071 | A | 10/2011 |
| JP | 2014-132628 | A | 7/2014 |
| JP | 2014-146788 | A | 8/2014 |
| JP | 5572673 | B2 | 8/2014 |
| JP | 2014-209546 | A | 11/2014 |
| KR | 20100097580 | A * | 9/2010 |
| WO | 2014/157448 | A1 | 10/2014 |
| WO | 2014/157451 | A1 | 10/2014 |
| WO | 2016/043039 | A1 | 3/2016 |

OTHER PUBLICATIONS

Extended European Search Report dated Mar. 15, 2018, issued in counterpart European Application No. 17192327.9. (7 pages).

Extended European Search Report, dated Dec. 1, 2017, issued in European Application No. 17175355.1 counterpart to co-pending U.S. Appl. No. 15/617,510 (in English; 12 pages).

Office Action, dated Nov. 13, 2018, issued in Japanese Application No. 2016-064942 counterpart to co-pending U.S. Appl. No. 15/087,241(w/ English machine translation; 6 pages).

Extended European Search Report dated Aug. 4, 02016, issued in European Application No. 16163097.5 counterpart to co-pending U.S. Appl. No. 15/087,241 (in English; 8 pages).

Kyoung-Hoon Bae et al., "Effect of WS2/Al co-doping on microstructural and magnetic properties of Nd—Fe—B sintered magnets", Journal of Alloys and Compounds, vol. 673, pp. 321-326, 2016 (in English; cited in co-pending U.S. Appl. No. 15/087,108).

Office Action dated Nov. 13, 2018, issued in Japanese Application No. 2016-064966 counterpart to co-pending U.S. Appl. No. 15/087,108 (w/ English machine translation; 6 pages).

Office Action dated Sep. 5, 2018, issued in co-pending U.S. Appl. No. 15/087,241 (23 pages; w/ PTO-892 and returned PTO/SB/08a).

Office Action dated Jan. 18, 2019, issued in co-pending U.S. Appl. No. 15/087,241 (9 pages; w/ returned PTO/SB/08a).

Office Action dated Dec. 22, 2017, issued in co-pending U.S. Appl. No. 15/087,108 (15 pages; w/ PTO-892 and returned PTO/SB/08a).

Office Action dated Mar. 27, 2019, issued in co-pending U.S. Appl. No. 15/087,108 (11 pages; w/ PTO-892 and returned PTO/SB/08a).

Office Action, dated Dec. 17, 2019, issued in Japanese Application No. 2017-109597 counterpart to co-pending U.S. Appl. No. 15/617,510 (w/ English machine translation; 6 pages).

* cited by examiner

METHOD FOR PREPARING R—FE—B SINTERED MAGNET

CROSS-REFERENCE TO RELATED APPLICATION

This non-provisional application claims priority under 35 U.S.C. § 119(a) on Patent Application No. 2016-187177 filed in Japan on Sep. 26, 2016, the entire contents of which are hereby incorporated by reference.

TECHNICAL FIELD

This invention relates to a method for preparing an R—Fe—B base sintered magnet having a high coercivity.

BACKGROUND ART

While Nd—Fe—B sintered magnets, referred to as Nd magnets, hereinafter, are regarded as the functional material necessary for energy saving and performance improvement, their application range and production volume are expanding every year. Since the automotive application assumes service in a hot environment, the Nd magnets incorporated in driving motors and power steering motors in hybrid vehicles and electric vehicles must have high coercivity as well as high remanence. The Nd magnets, however, tend to experience a substantial drop of coercivity at elevated temperature. Then the coercivity at room temperature must be preset fully high in order to insure an acceptable coercivity at service temperature.

As the means for increasing the coercivity of Nd magnets, it is effective to substitute Dy or Tb for part of Nd in $Nd_2Fe_{14}B$ compound as main phase. For these elements, there are short reserves, the mining areas amenable to commercial operation are limited, and geopolitical risks are involved. These factors indicate the risk that the price is unstable or largely fluctuates. Under the circumstances, in order that R—Fe—B magnets adapted for high-temperature service find a wider market, a new approach or magnet composition capable of increasing coercivity while minimizing the content of Dy and Tb is needed.

From this standpoint, several methods are already proposed. Patent Document 1 discloses an R—Fe—B base sintered magnet consisting essentially of 12-17 at % of R (wherein R stands for at least two of yttrium and rare earth elements and essentially contains Nd and Pr), 0.1-3 at % of Si, 5-5.9 at % of boron, 0-10 at % of Co, and the balance of Fe (with the proviso that up to 3 at % of Fe may be substituted by at least one element selected from among Al, Ti, V, Cr, Mn, Ni, Cu, Zn, Ga, Ge, Zr, Nb, Mo, In, Sn, Sb, Hf, Ta, W, Pt, Au, Hg, Pb, and Bi), containing an intermetallic compound $R_2(Fe,(Co),Si)_{14}B$ as main phase, and exhibiting a coercivity of at least 10 kOe. Further, the magnet is free of a boron-rich phase and contains at least 1 vol % based on the entire magnet of an R—Fe(Co)—Si grain boundary phase consisting essentially of 25-35 at % of R, 2-8 at % of Si, up to 8 at % of Co, and the balance of Fe. After sintering or heat treatment following sintering, the sintered magnet is cooled at a rate of 0.1 to 5° C./min at least in a temperature range from 700° C. to 500° C., or cooled in multiple stages including holding at a certain temperature for at least 30 minutes on the way of cooling, for thereby generating the R—Fe(Co)—Si grain boundary phase.

Patent Document 2 discloses a Nd—Fe—B alloy with a low boron content. A sintered magnet is prepared by sintering the alloy and cooling the sintered product below 300° C. The step of cooling down to 800° C. is at an average cooling rate $\Delta T1/\Delta t1<5K/min$.

Patent Document 3 discloses an R-T-B magnet comprising a main phase of $R_2Fe_{14}B$ and some grain boundary phases. One of the grain boundary phases is an R-rich phase containing more R than the main phase, and another is a transition metal-rich phase having a lower rare earth concentration and a higher transition metal concentration than the main phase. The R-T-B rare earth sintered magnet is prepared by sintering at 800 to 1,200° C. and heat treatment at 400 to 800° C.

Patent Document 4 discloses an R-T-B rare earth sintered magnet comprising a grain boundary phase containing an R-rich phase having a total atomic concentration of rare earth elements of at least 70 at % and a ferromagnetic transition metal-rich phase having a total atomic concentration of rare earth elements of 25 to 35 at %, wherein an area proportion of the transition metal-rich phase is at least 40% of the grain boundary phase. The sintered magnet is prepared by shaping an alloy material into a compact, sintering the compact at 800 to 1,200° C., and a plurality of heat treatments, i.e., first heat treatment of heating at a temperature of 650 to 900° C., cooling to 200° C. or below, and second heat treatment of heating at 450 to 600° C.

Patent Document 5 discloses an R-T-B rare earth sintered magnet comprising a main phase of $R_2Fe_{14}B$ and a grain boundary phase containing more R than the main phase, wherein the main phase of $R_2Fe_{14}B$ has an axis of easy magnetization parallel to c-axis, crystal grains of the main phase are of elliptic shape elongated in a direction perpendicular to the c-axis, and the grain boundary phase contains an R-rich phase having a total atomic concentration of rare earth elements of at least 70 at % and a transition metal-rich phase having a total atomic concentration of rare earth elements of 25 to 35 at %. Also described are sintering at 800 to 1,200° C. and subsequent heat treatment at 400 to 800° C. in an argon atmosphere.

Patent Document 6 discloses a rare earth magnet comprising a main phase of $R_2T_{14}B$ crystal grains and an intergranular grain boundary phase between two adjacent $R_2T_{14}B$ main phase crystal grains, wherein the intergranular grain boundary phase has a thickness of 5 nm to 500 nm and is composed of a phase having different magnetism from ferromagnetism. The intergranular grain boundary phase is formed of a compound which contains element T, but does not become ferromagnetic. Thus, the intergranular grain boundary phase contains a transition metal element and element M such as Al, Ge, Si, Sn or Ga. By further adding Cu to the rare earth magnet, a crystalline phase with a $La_6Co_{11}Ga_3$-type crystal structure may be evenly and broadly formed as the intergranular grain boundary phase, and a thin R—Cu layer may be formed at the interface between the $La_6Co_{11}Ga_3$-type intergranular grain boundary phase and the $R_2T_{14}B$ main phase crystal grains. As a result, the interface of the main phase can be passivated, the generation of strain due to a lattice mismatch be suppressed, and reverse magnetic domain-generating nuclei be inhibited. The method of preparing the magnet involves sintering, heat treatment at a temperature of 500 to 900° C., and cooling at a cooling rate of at least 100° C./min, especially at least 300° C./min.

Patent Documents 7 and 8 disclose an R-T-B sintered magnet comprising a main phase of $Nd_2Fe_{14}B$ compound and an intergranular grain boundary phase between two main phase grains, with a thickness of 5 to 30 nm, and having a grain boundary triple junction surrounded by three or more main phase grains.

CITATION LIST

Patent Document 1: JP 3997413 (U.S. Pat. No. 7,090,730, EP 1420418)
Patent Document 2: JP-A 2003-510467 (EP 1214720)
Patent Document 3: JP 5572673 (US 20140132377)
Patent Document 4: JP-A 2014-132628
Patent Document 5: JP-A 2014-146788 (US 20140191831)
Patent Document 6: JP-A 2014-209546 (US 20140290803)
Patent Document 7: WO 2014/157448
Patent Document 8: WO 2014/157451

DISCLOSURE OF INVENTION

Under the circumstances discussed above, there exists a need for an R—Fe—B base sintered magnet which exhibits a high coercivity despite a minimal content of Dy, Tb and Ho.

An object of the invention is to provide a method for preparing a novel R—Fe—B base sintered magnet exhibiting a high coercivity.

The inventors have found that an R—Fe—B base sintered magnet of a composition consisting essentially of 12 to 17 at % of R which is one or more elements selected from yttrium and rare earth elements and essentially contains Nd, 0.1 to 3 at % of $M_1$ which is at least one element selected from the group consisting of Si, Al, Mn, Ni, Cu, Zn, Ga, Ge, Pd, Ag, Cd, In, Sn, Sb, Pt, Au, Hg, Pb, and Bi, 0.05 to 0.5 at % of $M_2$ which is at least one element selected from the group consisting of Ti, V, Cr, Zr, Nb, Mo, If, Ta, and W, 4.8+2×m to 5.9+2×m at % of boron wherein m is at % of $M_2$, up to 10 at % of Co, up to 0.5 at % of carbon, up to 1.5 at % of oxygen, up to 0.5 at % of nitrogen, and the balance of Fe, and containing an intermetallic compound $R_2(Fe,(Co))_{14}B$ as a main phase, wherein the magnet contains the main phase and a grain boundary phase between grains of the main phase, the grain boundary phase containing a (R',HR)—Fe(Co)-$M_1$ phase in the form of an amorphous phase and/or nanocrystalline phase having a grain size of up to 10 nm, the (R',HR)—Fe(Co)-$M_1$ phase consisting essentially of 25 to 35 at % of (R',HR), 2 to 8 at % of $M_1$, up to 8 at % of Co, and the balance of Fe wherein R' is one or more elements selected from yttrium and rare earth elements exclusive of Dy, Tb and Ho, and essentially contains Nd, and HR is at least one element selected from Dy, Tb and Ho, the main phase contains an HR rich phase of $(R',HR)_2(Fe,(Co))_{14}$ B at its surface portion, the HR rich phase having a higher HR content than the HR content of the main phase at its center exhibits a high coercivity; and that the magnet can be prepared by the method defined below.

According to the invention, there is provided a method for preparing an R—Fe—B base sintered magnet, comprising the steps of:

providing an alloy fine powder having a composition consisting essentially of 12 to 17 at % of R which is at least one element selected from yttrium and rare earth elements and essentially contains Nd, 0.1 to 3 at % of $M_1$ which is at least one element selected from the group consisting of Si, Al, Mn, Ni, Cu, Zn, Ga, Ge, Pd, Ag, Cd, In, Sn, Sb, Pt, Au, Hg, Pb, and Bi, 0.05 to 0.5 at % of $M_2$ which is at least one element selected from the group consisting of Ti, V, Cr, Zr, Nb, Mo, Hf, Ta, and W, 4.8+2×m to 5.9+2×m at % of boron wherein m is at % of $M_2$, up to 10 at % of Co, up to 0.5 at % of carbon, up to 1.5 at % of oxygen, up to 0.5 at % of nitrogen, and the balance of Fe, compression shaping the alloy fine powder in an applied magnetic field into a compact, sintering the compact at a temperature of 900 to 1,250° C. into a sintered body, cooling the sintered body to a temperature of up to 400° C., high-temperature heat treatment including placing a metal, compound or intermetallic compound containing HR which is at least one element selected from Dy, Tb and Ho, on the surface of the sintered body, heating at a temperature from more than 950° C. 20 to 1,100° C., for causing grain boundary diffusion of HR into the sintered body, and cooling to a temperature of up to 400° C., and low-temperature heat treatment including heating at a temperature of 400 to 600° C. and cooling to a temperature of up to 300° C.

ADVANTAGEOUS EFFECTS OF INVENTION

The method is successful in preparing an R—Fe—B base sintered magnet which exhibits a high coercivity despite a minimal content of Dy, Tb and Ho.

DESCRIPTION OF PREFERRED EMBODIMENTS

Figure 1A:
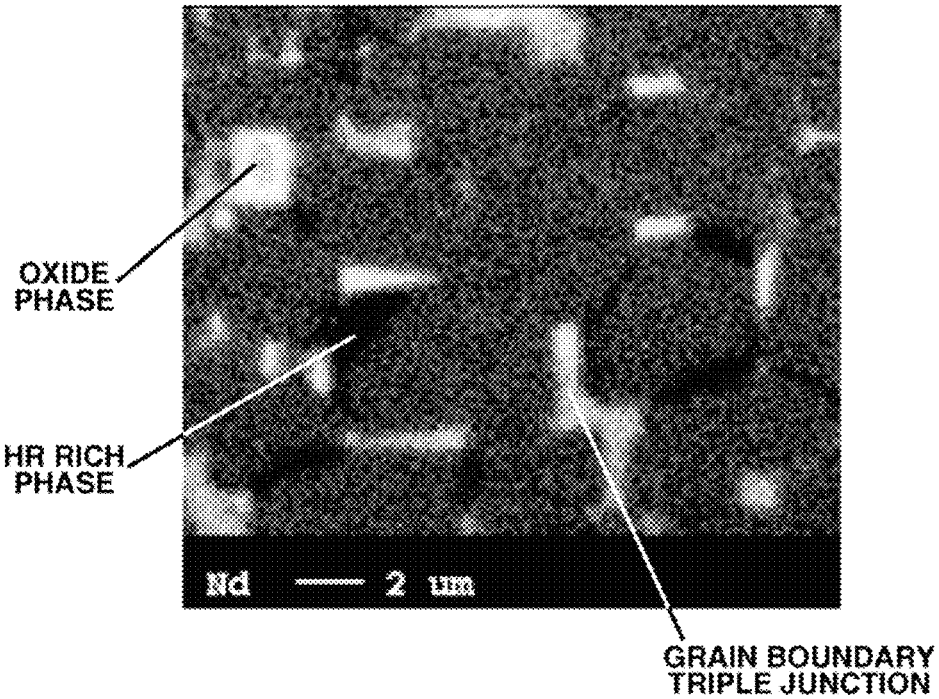
FIGS. 1A and 1B are images showing the distribution of Nd and Tb at a level of 200 μm inside the diffusion surface of the sintered magnet in Example 2, as observed by an electron probe microanalyzer (EPMA), respectively.

First, the composition of the R Fe B bow sintered magnet is described. The magnet has a composition (expressed in atomic percent) consisting essentially of 12 to 17 at % of R, 0.1 to 3 at % of $M_1$, 0.05 to 0.5 at % of $M_2$, 4.8+2×m to 5.9+2×m at % of boron wherein m is at % of $M_1$, up to 10 at % of Co (cobalt), up to 0.5 at % of C (carbon), up to 1.5 at % of O (oxygen), up to 0.5 at % of N (nitrogen), and the balance of Fe (iron) and incidental impurities.

Herein, R is one or more elements selected from yttrium and rare earth elements and essentially contains neodymium (Nd). The preferred rare earth elements other than Nd include Pr, La, Ce, Gd, Dy, Tb, and Ho, more preferably Pr, Dy, Tb, and Ho, with Pr being most preferred. The content of R is 12 to 17 at %, preferably at least 13 at % and up to 16 at %. If the content of R is less than 12 at %, the magnet has an extremely reduced coercivity. If the content of R exceeds 17 at %, the magnet has a low remanence (residual magnetic flux density) Br. Preferably essential element Nd accounts for at least 60 at %, especially at least 70 at %, based on the total of R. When R contains at least one element of Pr, La, Ce and Gd as the rare earth element other than Nd, an atomic ratio of Nd to at least one element of Pr, La, Ce and Gd is preferably from 75/25 to 85/15. When R contains Pr as the rare earth element other than Nd, didymium which is a mixture of Nd and Pr may be used, and an atomic ratio of Nd to Pr may be from 77/23 to 83/17, for example.

When R contains at least one element of Dy, Tb and Ho, the total content of Dy, Tb and Ho is preferably up to 20 at %, more preferably up to 10 at %, even more preferably up to 5 at %, and most preferably up to 3 at %, and at least 0.06 at %, based on the total of R. The total content of Dy, Tb and Ho relative to the overall magnet composition is preferably up to 3 at %, more preferably up to 1.5 at %, even more preferably up to 1 at %, and most preferably up to 0.4 at %, and at least 0.01 at %. When at least one element of Dy, Tb and Ho is diffused via grain boundary diffusion, the amount of element diffused is preferably up to 0.7 at %, more preferably up to 0.4 at % and at least 0.05 at %.

$M_1$ is at least one element selected from the group consisting of Si, Al, Mn, Ni, Cu, Zn, Ga, Ge, Pd, Ag, Cd, In, Sn, Sb, Pt, Au, Hg, Pb, and Bi. $M_1$ is an element necessary to form the (R',HR)—Fe(Co)-$M_1$ phase to be described later. The inclusion of the predetermined content of $M_1$ ensures to form the (R',HR)—Fe(Co)-$M_1$ phase in a stable manner. The content of $M_1$ is 0.1 to 3 at %, preferably at least 0.5 at % and up to 2.5 at %. If the content of $M_1$ is less than 0.1 at %, the (R',HR)—Fe(Co)-$M_1$ phase is present in the grain boundary phase in too low a proportion to improve coercivity. If the content of $M_1$ exceeds 3 at %, the magnet has poor squareness and a low remanence Br.

$M_2$ is at least one element selected from the group consisting of Ti, V, Cr, Zr, Nb, Mo, Hf, Ta and W. $M_2$ is added for the purposes of inhibiting growth of abnormal grains during sintering and forming a boride in a stable manner. The content of M is 0.05 to 0.5 at %. The addition of $M_2$ enables sintering at relatively high temperature during magnet preparation, leading to improvements in squareness and magnetic properties.

The content of boron (B) is (4.8+2×m) to (5.9+2×m) at %, preferably at least (4.9+2×m) at % and up to (5.7+2×m) at %, wherein m is a content (at %) of $M_2$. Differently stated, since the content of $M_2$ element in the magnet composition is in the range of 0.05 to 0.5 at %, the range of B content varies with a particular content of $M_2$ element in this range. Specifically the content of B Is from 4.9 at % to 6.9 at %, more specifically at least 5.0 at % and up to 6.7 at %. In particular, the upper limit of B content is crucial. If the B content exceeds (5.9+2×m) at %, the (R',HR)—Fe(Co)-$M_1$ phase is not formed at the grain boundary, and instead, an $R_{1.1}Fe_{14}B_4$ compound phase or $(R',HR)_{1.1}Fe_4B_4$ compound phase, which is so-called B-rich phase, is formed. If the B-rich phase is present in the magnet, the coercivity of the magnet is not fully increased. If the B content is less than (4.8+2×m) at %, the percent volume of the main phase is reduced, and magnetic properties are degraded.

Cobalt (Co) is optional. For the purpose of improving Curie temperature and corrosion resistance, Co may substitute for part of Fe. When Co is contained, the Co content is preferably up to 10 at %, more preferably up to 5 at %. A Co content in excess of 10 at % is undesirable because of a substantial loss of coercivity. More preferably the Co content is up to 10 at %, especially up to 5 at % based on the total of Fe and Co. The expression "Fe,(Co)" or "Fe(Co)" is used to indicate two cases where cobalt is contained and not contained.

The contents of carbon, oxygen and nitrogen are desirably as low as possible and more desirably nil. However, such elements are inevitably introduced during the magnet preparation process. A carbon content of up to 0.5 at %, especially up to 0.4 at %, an oxygen content of up to 1.5 at %, especially up to 1.2 at %, and a nitrogen content of up to 0.5 at %, especially up to 0.3 at % are permissible.

The balance is iron (Fe). The Fe content is preferably at least 70 at %, more preferably at least 75 at % and up to 85 at %, more preferably up to 80 at % based on the overall magnet composition.

It is permissible that the magnet contains other elements such as H, F, Mg, P, S, Cl and Ca as the incidental impurity in an amount of up to 0.1% by weight based on the total weight of constituent elements and impurities. The content of incidental impurities is desirably as low as possible.

The R—Fe—B base sintered magnet preferably has an average crystal grain sine of up to 6 μm, more preferably up to 5.5 μm, and even more preferably up to 5 μm, and at least 1.5 μm, more preferably at least 2 μm. The average grain size of the sintered body may be controlled by adjusting the average particle size of alloy powder during fine milling. The average size of crystal grains is measured by the following procedure, for example. First, a section of sintered magnet is polished to mirror finish, immersed in an etchant such as vilella solution (mixture of glycerol:nitric acid: hydrochloric acid=3:1:2) for selectively etching the grain boundary, and observed under a laser microscope. On analysis of the image, the cross-sectional area of individual grains is determined, from which the diameter of an equivalent circle is computed. Based on the data of area fraction of each grain size, the average grain size is determined. The average grain size is typically an average for about 2,000 grains taken from images of 20 different areas.

Preferably the R—Fe—B base sintered magnet has a remanence Br of at least 1 kG (1.1 T), more preferably at least 11.5 kG (1.15 T), and even more preferably at least 12 kG (1.2 T) at room temperature (23° C.). Also preferably the R—Fe—B base sintered magnet has a coercivity Hcj of at least 10 kOe (796 kA/m), more preferably at least 14 kOe (1,114 kA/m), and even more preferably at least 16 kOe (1,274 kA/m) at room temperature (−23° C.).

In the structure of the inventive magnet, a main phase (crystal grains) and a grain boundary phase are present. The main phase contains a phase of $R_2(Fe,(Co))_{14}B$ intermetallic compound. The compound may be expressed as $R_2Fe_{14}B$ when cobalt-free, and as $R_2(Fe,Co)_{14}B$ when it contains cobalt.

The main phase contains an HR rich phase which contains a phase: $(R',HR)_2(Fe,(Co))_{14}B$ wherein R' is one or more elements selected from yttrium and rare earth elements exclusive of Dy, Tb and Ho, and essentially contains Nd, and HR is at least one element selected from Dy, Tb and Ho. The compound may be expressed as $(R',HR)_2Fe_{14}B$ when cobalt-free, and as $(R',HR)_2(Fe,Co)_{14}B$ when it contains cobalt. The HR rich phase is a phase of intermetallic compound having a higher HR content than the HR content of the main phase at its center. Of elements R', the rare earth elements other than Nd are preferably Pr, La, Ce and Gd, with Pr being most preferred. The HR rich phase is formed at a surface portion of the main phase.

Preferably the HR rich phase is non-uniformly formed at the surface portion of the main phase. The HR rich phase may be formed throughout the surface portion of the main phase, for example, so as to cover the overall portion (i.e., interior) of the main phase other than the HR rich phase. In this case, the HR rich phase preferably has a non-uniform thickness, and includes a thickest portion and a thinnest portion. A thickness ratio of the thickest portion to the thinnest portion is preferably at least 1.5/1, more preferably at least 2/1, and even more preferably at least 3/1.

Alternatively, the HR rich phase may be formed partially in the surface portion of the main phase, for example, so as to cover only parts of the portion of the main phase other than the HR rich phase. In this case, the thickest portion of the HR rich phase has a thickness of preferably at least 0.5%, more preferably at least 1%, even more preferably at least 2% and up to 40%, more preferably up to 30%, even more preferably up to 25% of the crystal grain size of the main phase.

The thinnest portion of the HR rich phase preferably has a thickness of at least 0.01 μm, more preferably at least 0.02 μm. The thickest portion of the HR rich phase preferably has a thickness of up to 2 μm, more preferably up to 1 μm. If the thinnest portion of the HR rich phase has a thickness of less than 0.01 μm, the coercivity enhancing effect may become insufficient. If the thickest portion of the HR rich phase has a thickness in excess of 2 μm, the remanence Br may become low.

In the HR rich phase, HR substitutes for the site occupied by R. The HR rich phase has a Nd content which is preferably up to 80%, more preferably up to 75%, and even more preferably up to 70% of the Nd content at the center of the main phase. If the Nd content of the HR rich phase is above the range, the coercivity enhancing effect of HR may become insufficient.

In a preferred embodiment, the area of the HR rich phase as evaluated in a cross section taken at a depth of 200 μm from the surface of the sintered magnet (e.g., the diffusion surface during grain boundary diffusion treatment to be described later) is at least 2%, preferably at least 4%, and more preferably at least 5% of the overall area of the main phase. If the areal proportion of the HR rich phase is less than the range, the coercivity enhancing effect of HR may become insufficient. Further preferably, the area of the HR rich phase is up to 40%, more preferably up to 30%, and even more preferably up to 25% of the overall area of the main phase. If the areal proportion of the HR rich phase exceeds the range, the remanence Br may become low.

The HR rich phase has an HR content which is preferably at least 150%3 more preferably at least 200%, and even more preferably at least 300% of the HR content at the center of the main phase. If the HR content of the HR rich phase is below the range, the coercivity enhancing effect may become insufficient.

Also in the HR rich phase, the HR content is preferably at least 20 at %, more preferably at least 25 at %, and even more preferably at least 30 at % based on the total of R' and HR. The HR content of the HR rich phase is further preferably more than 30 at %, especially at least 31 at % based on the total of R' and HR. If the HR content of the HR rich phase is below the range, the coercivity enhancing effect may become insufficient.

The structure of the inventive magnet further contains a grain boundary phase formed among grains of the main phase. The grain boundary phase contains a (R',HR)—Fe(Co)-$M_1$ phase. The phase may be expressed as (R',HR)—Fe-$M_1$ when cobalt-free, and as (R',HR)—FeCo-$M_1$ when it contains cobalt.

The grain boundary phase may contain a (R',HR)-$M_1$ phase, preferably a (R',HR)-$M_1$ phase having a total content of R' and HR which is at least 50 at %, a $M_2$ boride phase, and the like, especially a $M_2$ boride phase at the grain boundary triple junction. The structure of the inventive magnet may contain as the grain boundary phase an R rich phase or (R',HR) rich phase as well as phases of compounds of incidental impurities (introduced during the magnet preparation process) such as R or (R',HR) carbide, R or (R',HR) oxide, R or (R',HR) nitride, R or (R',HR) halide, and R or (R',HR) oxyhalide. It is preferred that neither $R_2(Fe,(Co))_{17}$ phase or $(R',HR)_2(Fe,(Co))_7$ phase nor $R_{1.1}(Fe,(Co))_4B_4$ or $(R',HR)_{1.1}(Fe,(Co))_4B_4$ phase be present over at least grain boundary triple junctions, especially all intergranular grain boundaries and grain boundary triple junctions (overall grain boundary phase).

Preferably the grain boundary phase is formed outside crystal grains of the main phase. In the structure of the magnet, (R',HR)—Fe(Co)-$M_1$ phase is preferably present in an amount of at least 1% by volume. If the amount of (R',HR)—Fe(Co)-$M_1$ phase is less than 1% by volume, a high coercivity may not be obtained. The amount of (R',HR)—Fe(Co)-$M_1$ phase is preferably up to 20% by volume, more preferably up to 10% by volume. If the amount of (R',HR)—Fe(Co)-$M_1$ phase exceeds 20% by volume, the outcome may be a substantial drop of remanence Br.

The (R',HR)—Fe(Co)-$M_1$ phase is a phase of a compound containing only Fe when Co is not contained and a compound containing Fe and Co when Co is contained and is considered as an intermetallic compound phase having a crystal structure of space group 14/mcm. Exemplary phases include $(R',HR)_6(Fe,(Co))_{13}(M_1)$ phases such as $(R',HR)_6(Fe,(Co))_{13}Si$ phase, $(R',HR)(Fe,(Co))_{13}Ga$ phase, and $(R',HR)_6(Fe,(Co))_{13}Al$ phase. The (R',HR)—Fe(Co)-$M_1$ phase is distributed so as to surround crystal grains of the main phase, whereby adjacent main phases are magnetically divided, leading to an improvement in coercivity.

The (R',HR)—Fe(Co)-$M_1$ phase is considered as a phase of R—Fe(Co)-$M_1$ wherein a part of R is HR. The (R',HR)—Fe(Co)-$M_1$ phase has a HR content which is preferably up to 30 at % based on the total of R' and HR. In general, the R—Fe(Co)-$M_1$ phase can form a stable compound phase with a light rare earth element such as La, Pr or Nd, and when a part of the rare earth element is replaced by a heavy rare earth element (HR) such as Dy, Tb or Ho, it forms a stable phase until the HR content reaches 30 at %. If the HR content exceeds 30 at %, a ferromagnetic phase such as $(R',HR)_1Fe_3$ phase will form during the low-temperature heat treatment to be described later, leading to declines of coercivity and squareness. The lower limit of the HR content is typically at least 0.1 at %, though not critical.

In the (R',HR)—Fe(Co)-$M_1$ phase, $M_1$ preferably consists of:

(1) 0.5 to 50 at % of Si and the balance of at least one element selected from Al, Mn, Ni, Cu, Zn, Ga, Ge, Pd, Ag, Cd, In, Sn, Sb, Pt, Au, Hg, Pb, and Bi, (2) 1.0 to 80 at % of Ga and the balance of at least one element selected from Si, Al, Mn, Ni, Cu, Zn, Ge, Pd, Ag, Cd, In, Sn, Sb, Pt, Au, Hg, Pb, and Bi, or (3) 0.5 to 50 at % of Al and the balance of at least one element selected from Si, Mn, Ni, Cu, Zn, Ga, Ge, Pd, Ag, Cd, In, Sn, Sb, Pt, Au, Hg, Pb, and Bi.

These elements form the aforementioned intermetallic compounds (specifically $(R',HR)_6(Fe,(Co))_{13}(M_1)$ phases such as $(R',HR)_6(Fe,(Co))_{13}Si$ phase, $(R',HR)_6(Fe,(Co))_{13}Ga$ phase, and $(R',HR)(Fe,(Co))_{13}Al$ phase) in a stable manner, and provide mutual substitution at $M_1$ site. Even when a composite compound with an element at $M_1$ site is formed, no significant difference in magnetic properties is observed, but in practice, there are achieved stabilization of quality due to a minimized variation of magnetic properties and a cost reduction due to a reduced amount of expensive element added.

In the R—Fe—B base sintered magnet, the grain boundary phase is preferably distributed so as to surround individual crystal grains of the main phase at intergranular grain boundaries and grain boundary triple junctions. More preferably, individual crystal grains each are separated from adjacent crystal grains by the grain boundary phase. For example, with a focus on individual crystal grains of the main phase, a structure in which a main phase grain serves as core and the grain boundary phase encloses the grain as shell (i.e., structure similar to the so-called core/shell structure) is preferred. With this structure, adjacent main phase grains are magnetically divided, leading to a further improvement in coercivity. To insure magnetic division between main phase grains, the narrowest portion of the grain boundary phase interposed between two adjacent main phase grains preferably has a thickness of at least 10 nm, especially at least 20 nm and up to 500 nm, especially up to 300 nm. If the width of grain boundary phase is narrower than 10 nm, a sufficient coercivity enhancing effect due to magnetic division may not be obtained. The narrowest portion of the grain boundary phase interposed between two adjacent main phase grains preferably has an average thickness of at least 50 nm, especially at least 60 nm and up to 300 nm, especially up to 200 nm.

The surface coverage of main phase grains with the grain boundary phase is preferably at least 50%, more preferably at least 60%, and even more preferably at least 70%. Even the entire surface of main phase grains may be covered with the grain boundary phase. The remainder of the grain boundary phase is, for example, (R',HR)-$M_1$ phase having a total content of R' and HR which is at least 50 at %, $M_2$ boride phase and the like.

The grain boundary phase should preferably contain a (R',HR)—Fe(Co)-$M_1$ phase consisting essentially of 25 to 35 at % of R, 2 to 8 at % of $M_1$, up to 8 at % (i.e., 0 at % or from more than 0 at % to 8 at %) of Co, and the balance of Fe wherein R' is one or more elements selected from yttrium and rare earth elements exclusive of Dy, Tb and Ho, and essentially contains Nd, and HR is at least one element selected from Dy, Tb and Ho. This composition may be quantified by an analytic technique such as electron probe microanalyzer (EPMA). The $M_1$ site may be mutually substituted by a plurality of elements.

Preferably the (R',HR)—Fe(Co)-$M_1$ phase is present in the form of an amorphous phase and/or nanocrystalline phase having a grain size of up to 10 nm, preferably less than 10 nm. As crystallization of (R',HR)—Fe(Co)-$M_1$ phase proceeds, the (R',HR)—Fe(Co)-$M_1$ phase agglomerates at grain boundary triple junctions, and as a result, the width of intergranular grain boundary phase becomes narrow or discontinuous, resulting in a magnet with a low coercivity. With the progress of crystallization of (R',HR)—Fe(Co)-$M_1$ phase, sometimes R rich phase or (R',HR) rich phase will form at the interface between grains of the main phase and the grain boundary phase. However, coercivity is not significantly improved by the formation of R rich phase or (R',HR) rich phase.

On the other hand, when (R',HR)-$M_1$ phase and/or $M_2$ boride phase is present, these phases are preferably present in the form of an amorphous phase and/or nano-crystalline phase having at grain size of up to 10 nm, preferably less than 10 nm.

Now the method for preparing the R—Fe—B base sintered magnet according to the invention is described. The method for preparing the R—Fe—B base sintered magnet involves several steps which are generally the same as in ordinary powder metallurgy methods. Specifically, the method involves the step of providing an alloy fine powder having a predetermined composition (including melting feed materials to form a source alloy and grinding the source alloy), the step of compression shaping the alloy fine powder in an applied magnetic field into a compact, the step of sintering the compact into a sintered body, and the step of cooling the sintered body.

The step of providing an alloy fine powder having a predetermined composition includes melting feed materials to form a source alloy and grinding the source alloy. In the melting step, feed materials including metals and alloys are weighed so as to meet the predetermined composition, for example, a composition consisting essentially of 12 to 17 at % of R which is one or more elements selected from yttrium and rare earth elements and essentially contains Nd and preferably Pr as well, 0.1 to 3 at % of $M_1$ which is at least one element selected from among Si, Al, Mn, Ni, Cu, Zn, Ga, Ge, Pd, Ag, Cd, In, Sn, Sb, Pt, Au, Hg, Pb, and Bi, 0.05 to 0.5 at % of $M_2$ which is at least one element selected from among Ti, V, Cr, Zr, Nb, Mo, Hf, Ta, and W, 4.8+2×m to 5.9+2×m at % of boron wherein m is at % of $M_2$, up to 10 at % of Co, up to 0.5 at % of carbon, up to 1.5 at % of oxygen, up to 0.5 at % of nitrogen, and the balance of Fe, typically free of carbon, oxygen and nitrogen. The feed materials are melted in vacuum or an inert gas atmosphere, preferably inert gas atmosphere, typically argon atmosphere, by high-frequency heating, cast and cooled into a source alloy. In the composition of feed materials including metals and alloys, R may or may not contain at least one element (HR) selected from Dy, Tb and Ho. For casting of source alloy, either a standard melt casting method (such as casting the melt into a flat mold or book mold) or strip casting method may be used. If primary crystals of α-Fe are left in the cast alloy, the alloy may be heat treated in vacuum or an inert gas atmosphere, typically argon gas at 700 to 1,200° C. for at least 1 hour, for thereby making the microscopic structure uniform and erasing the α-Fe phase.

The step of grinding the source alloy includes coarse grinding such as mechanical crushing on a Brown mill or the like or hydrogen decrepitation to an average particle size of at least 0.05 mm and up to 3 mm, especially up to 1.5 mm. The preferred coarse grinding step is hydrogen decrepitation when the alloy is prepared by strip casting. The coarse grinding step is followed by fine milling such as jet milling with the aid of high pressure nitrogen, for example, into an alloy fine powder having an average particle size of at least 0.2 μm, especially at least 0.5 μm and up to 30 μm, specifically up to 20 μm, especially up to 10 μm. If desired, a lubricant or another additive may be added in one or both of coarse grinding and fine milling steps.

Also applicable to the preparation of the alloy powder is a so-called two-alloy process involving separately preparing a mother alloy approximate to the $R_2$-$T_{14}$-$B_1$ composition (wherein T is Fe or Fe and Co) and a rare earth (R)-rich alloy serving as sintering aid, crushing, weighing and mixing the mother alloy and sintering aid, and milling the mixed powder. The sintering aid alloy may be prepared by the casting technique mentioned above or melt-spun technique.

In the shaping step using a compression shaping machine, the alloy fine powder is compression shaped into a compact under an applied magnetic field, for example, of 5 kOe (398 kA/m) to 20 kOe (1,592 kA/m), for orienting the axis of easy magnetization of alloy particles. The shaping is preferably performed in vacuum or inert gas atmosphere, especially nitrogen or argon gas atmosphere, to prevent alloy particles from oxidation.

The compact is then sintered into a sintered body. The sintering step is preferably at a temperature of at least 900° C., more preferably at least 1,000° C., especially at least 1,050° C. and up to 1,250° C., more preferably up to 1,150° C., especially up to 1,100° C., typically for a time of 0.5 to 5 hours. After sintering, the sintered body is cooled to a temperature of preferably up to 400° C., more preferably up to 300° C., even more preferably up to 200° C. The cooling rate is preferably at least 1° C./min, more preferably at least 5° C. main and up to 100° C./min, more preferably up to 50° C./min until the upper limit of the temperature range is reached although the cooling rate is not particularly limited. If necessary, the sintered body is aged, for example, at 400 to 600° C. for 0.5 to 50 hours, and thereafter cooled typically to normal temperature.

At this point, the sintered body (sintered magnet body) may be subjected to heat treatment. This heat treatment step preferably includes two stages of heat treatment: high-temperature heat treatment step of heating the sintered body, which has been cooled to a temperature of up to 400° C., at a temperature of at least 700° C., especially at least 800° C. and up to 1,100° C., especially up to 1,050° C. and cooling to a temperature of up to 400° C. again, and low-temperature heat treatment step of heating the sintered body at a temperature of 400 to 600° C. and cooling to a temperature of up to 300° C., especially up to 200° C. The heat treatment atmosphere is preferably vacuum or an inert gas atmosphere, typically argon gas.

The heating rate of the high-temperature heat treatment is preferably at least 1° C./min, especially at least 2° C./min and up to 20° C./min, especially up to 10° C./min though not particularly limited. The holding time of the high-temperature heat treatment is preferably at least 1 hour, and typically up to 10 hours, preferably up to 5 hours. After heating, the sintered body is cooled to a temperature of up to 400° C., more preferably up to 300° C., and even more preferably up to 200° C. The cooling rate is preferably at least 1° C./min, more preferably at least 5° C./min and up to 100° C./min, more preferably up to 50° C./min until the upper limit of the temperature range is reached although the cooling rate is not particularly limited.

In the low-temperature heat treatment step following the high-temperature heat treatment step, the once cooled sintered body is heated at a temperature of at least 400° C., preferably at least 450° C. and up to 600° C., preferably up to 550° C. The heating rate of the low-temperature heat treatment is preferably at least 1° C./min, especially at least 2° C./min and up to 20° C./min, especially up to 10° C./min though not particularly limited. The holding time of the low-temperature heat treatment is preferably at least 0.5 hour, especially at least 1 hour, and up to 50 hours, especially up to 20 hours. The cooling rate is preferably at least 1° C./min, more preferably at least 5° C./min and up to 100° C./min, more preferably up to 80° C./min, even more preferably up to 50° C./min until the upper limit of the temperature range is reached although the cooling rate is not particularly limited. After the heat treatment, the sintered body is cooled typically to normal temperature.

Various parameters in the high- and low-temperature heat treatments may be adjusted as appropriate in their ranges defined above, depending on variations associated with the preparation process excluding the high- and low-temperature heat treatments, for example, the species and content of element $M_1$, the concentration of impurities, especially impurities introduced from the atmosphere gas during the preparation process, and sintering conditions.

In the practice of the invention, the HR rich phase containing $(R',HR)_2(Fe,(Co))_4B$ phase and the grain boundary phase containing (R',HR)—Fe(Co)-$M_1$ phase may be formed by a grain boundary diffusion process. In the grain boundary diffusion process, the sintered compact is machined into a magnet body of desired shape or size approximate to the final product by cutting or surface grinding, if necessary, a metal, compound or intermetallic compound containing an element HR wherein HR is at least one element selected from Dy, Tb and Ho, for example, in powder or thin film form, is placed on the surface of the sintered body to enclose the sintered body, and treatment is carried out to introduce HR element in the metal, compound or intermetallic compound from the surface to the bulk of the sintered body via the grain boundary phase. Notably, in the portion of the main phase other than the HR rich phase, HR element may form a solid solution via grain boundary diffusion, but preferably does not form a solid solution at the center of the main phase. On the other hand, it is preferred that rare earth elements other than HR element do not form a solid solution in the main phase via grain boundary diffusion.

The grain boundary diffusion process of introducing HR element in the magnet body from its surface into its bulk along the grain boundary phase may be (1) a process of placing a powder of a HR-containing metal, compound or intermetallic compound on the surface of the sintered body and heat treating in vacuum or inert gas atmosphere (e.g., dip coating process), (2) a process of forming a thin film of a HR-containing metal, compound or intermetallic compound on the surface of the sintered body in high vacuum and heat treating in vacuum or inert gas atmosphere (e.g., sputtering process), or (3) a process of heating a HR-containing metal, compound or intermetallic compound in high vacuum to create a HR-containing vapor phase, and supplying and diffusing the HR element into the sintered body from the vapor phase (e.g., vapor diffusion process). Of these, processes (1) and (2) are preferred, with process (1) being most preferred.

Suitable HR-containing metals, compounds or intermetallic compounds include single metal of HR, alloys of HR, oxides, halides, oxyhalides, hydroxides, carbides, carbonates, nitrides, hydrides, and borides of HR, and intermetallic compounds of HR and transition metals such as Fe, Co and Ni wherein part of the transition metal may be substituted by at least one element selected from among Si, Al, Ti, V, Cr, Mn, Cu, Zn, Ga, Ge, Pd, Ag, Cd, Zr, Nb, Mo, In, Sn, Sb, Hf, Ta, W, Pt, Au, Hg, Pb, and Bi.

The thickness of the HR rich phase may be controlled by adjusting the amount of HR element added or the amount of HR element diffused into the sintered body bulk, or the temperature and time of grain boundary diffusion treatment.

In order to form the HR rich phase containing (R',HR)$(Fe,(Co))_{14}B$ phase and the grain boundary phase containing (R',HR)—Fe(Co)-$M_1$ phase via grain boundary diffusion, a HR-containing metal, compound or intermetallic compound, for example, in powder or thin film form, is placed on the surface of the sintered body, which has been cooled after sintering or after heat treatment prior to grain boundary diffusion process, to enclose the sintered body. The sintered body is subjected to high-temperature heat treatment including heating at a temperature of more than 950° C., preferably at least 960° C., more preferably at least 975° C. and up to 1,100° C., preferably up to 1,050° C., more preferably up to 1,030@C for causing grain boundary diffusion of HR element into the sintered body, and then cooling to a temperature of up to 400° C., preferably up to 300° C., more preferably up to 200° C. The heat treatment atmosphere is in vacuum or an inert gas atmosphere such as argon gas.

If the heating temperature is below the range, the coercivity enhancing effect may become insufficient. If the heating temperature is above the range, a lowering of coercivity due to grain growth may occur. The heating temperature is preferably equal to or higher than the peritectic point (decomposition temperature) of (R',HR)—Fe(Co)-$M_1$ phase. The high-temperature stability of (R',HR)—Fe(Co)-$M_1$ phase varies with the species of $M_1$, and the peritectic point at which (R',HR)—Fe(Co)-$M_1$ phase forms is different with the species of $M_1$. Specifically, the peritectic point is 640° C. for $M_1$=Cu, 750° C. for $M_1$=Al, 850° C. for $M_1$=Ga, 890° C. for $M_1$=Si, 960° C. for $M_1$=Ge, and 890° C. for $M_1$=In. The heating rate is preferably at least 1° C./min, especially at least 2° C./min and up to 20° C./min, especially up to 10° C./min though not particularly limited. The heating time is preferably at least 0.5 hour, more preferably at least 1 hour and up to 50 hours, more preferably up to 20 hours.

The cooling rate after heating is preferably at least 1° C./min, more preferably at least 5° C./min and up to 100° C./min, more preferably up to 50° C./min until the upper limit of the temperature range is reached although the cooling rate is not particularly limited. If the cooling rate is less than the range, the (R',HR)—Fe(Co)-$M_1$ phase segregates at grain boundary triple junctions, exacerbating magnetic properties. If the cooling rate exceeds 100° C./min, the segregation of (R',HR)—Fe(Co)-$M_1$ phase during the cooling step is inhibited, but the squareness of the sintered magnet can be degraded.

After the high-temperature heat treatment, the sintered body is subjected to low-temperature heat treatment including heating at a temperature of at least 400° C., preferably at least 430° C. and up to 600° C., preferably up to 550° C., and then cooling to a temperature of up to 300° C., preferably up to 200° C. The heat treatment atmosphere is in vacuum or an inert gas atmosphere such as argon gas.

It is effective for forming (R',HR)—Fe(Co)-$M_1$ phase as the grain boundary phase that the heating temperature is lower than the peritectic point of (R',HR)—Fe(Co)-$M_1$ phase. If the heating temperature is below 400° C., the reaction rate of forming (R',HR)—Fe(Co)-$M_1$ phase may become very slow. If the heating temperature exceeds 600° C., the reaction rate of forming (R',HR)—Fe(Co)-$M_1$ phase becomes so fast that (R',HR)—Fe(Co)-$M_1$ grain boundary phase may substantially segregate at grain boundary triple junctions, adversely affecting magnetic properties.

The heating rate of the low-temperature heat treatment is preferably at least 1° C./min, especially at least 2° C./min and up to 20° C./min, especially up to 10° C./min though not particularly limited. The holding time is preferably at least 0.5 hour, more preferably at least 1 hour and up to 50 hours, more preferably up to 20 hours. The cooling rate after heating is preferably at least 1° C./min, more preferably at least 5° C./min and up to 100° C./min, more preferably up to 80° C./min, most preferably up to 50° C./min until the upper limit of the temperature range is reached although the cooling rate is not particularly limited. After the low-temperature heat treatment, the sintered body is cooled typically to normal temperature.

EXAMPLE

Examples are given below for further illustrating the invention although the invention is not limited thereto.

Reference Examples 1 and 2

A ribbon form alloy was prepared by the strip casting technique, specifically by using Nd or didymium (mixture of Nd and Pr) as rare earth element R, electrolytic iron, cobalt, metals or alloys as element Ms and element $M_2$, and ferroboron (Fe—B alloy), weighing them so as to meet the desired composition shown in Table 1, melting the mix in an Ar gas atmosphere on a high-frequency induction furnace, and strip casting the melt onto a water-cooled copper chill roll. The ribbon form alloy had a thickness of about 0.2 to 0.3 mm.

The alloy was subjected to hydrogen decrepitation, that is, hydrogen absorption at normal temperature and subsequent heating at 600° C. in vacuum for hydrogen desorption. To the resulting alloy powder, 0.07 wt % of stearic acid as lubricant was added and mixed. The coarse powder was finely milled on a jet mill using nitrogen stream, into a fine powder having an average particle size of about 3 μm.

In an inert gas atmosphere, a mold of a compacting machine was charged with the fine powder. While a magnetic field of 15 kOe (1.19 MA/m) was applied for orientation, the powder was compression molded in a direction perpendicular to the magnetic field. The compact was sintered in vacuum at 1,050-1,100° C. for 3 hours, cooled to or below 200° C., and aged at 450-530° C. for 2 hours, yielding a sintered body (sintered magnet body). The composition of this sintered body is shown in Table 1 and its magnetic properties are shown in Table 2. It is noted that a parallelepiped block of 6 mm×6 mm×2 mm was cut out of the sintered body at the center and evaluated for magnetic properties.

Examples 1 to 6 & Comparative Examples 1 to 3

The sintered body obtained in Reference Example 1 was machined into a parallelepiped block of 20 mm×20 mm×2.2 mm. It was immersed in a slurry of terbium oxide particles with an average particle size of 0.5 μm in ethanol at a weight fraction of 50%, and dried, forming a coating of terbium oxide on the surface of the sintered body. The thus coated sintered body was subjected to high-temperature heat treatment including heating in vacuum at the holding temperature for the holding time shown in Table 2, and then cooling down to 200° C. at the cooling rate shown in Table 2. Thereafter, the sintered body was subjected to low-temperature heat treatment including heating at the holding temperature shown in Table 2 for 2 hours, and then cooling down to 200° C. at the cooling rate shown in Table 2, yielding a sintered magnet. The composition of this sintered magnet is shown in Table 1 and its magnetic properties are shown in Table 2. It is noted that a parallelepiped block of 6 mm×6 mm×2 mm was cut out of the sintered magnet at the center and evaluated for magnetic properties.

Figure 1B:
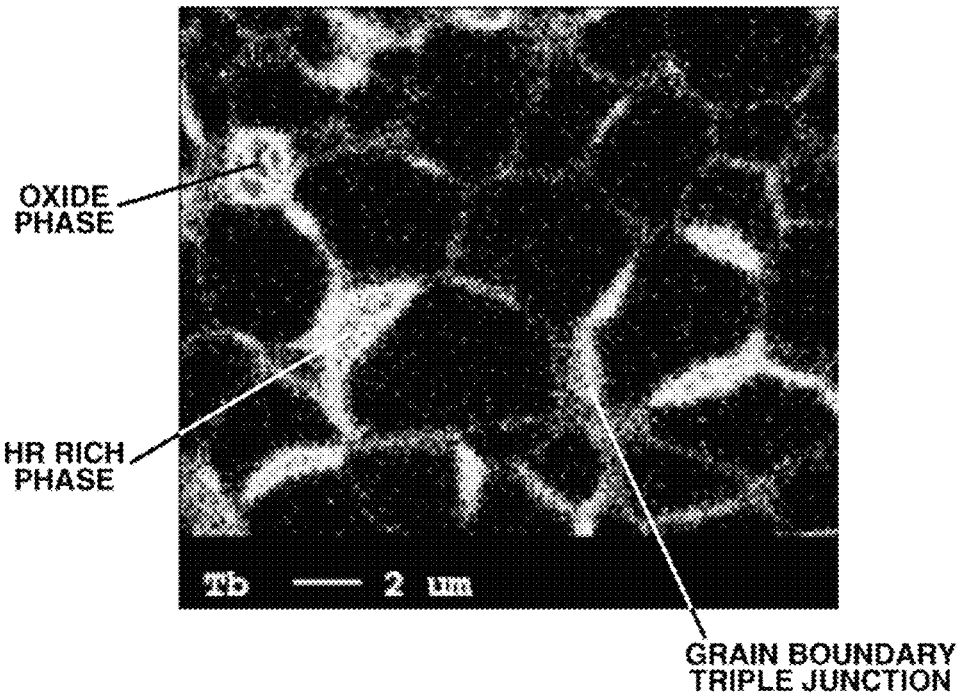

FIGS. 1A and 1B are images showing the distribution of Nd and Tb at a level of 200 μm inside the diffusion surface of the sintered magnet in Example 2, as observed by EPMA, respectively. It is seen that Tb has diffused via the grain boundary phase whereby HR rich phase is formed non-uniformly in a surface portion of the main phase. It was confirmed that this HR rich phase was $(R',HR)_2(Fe,(Co))_{14}B$ phase, and present at bi-granular grain boundaries and grain boundary triple junctions, especially thickly at grain boundary triple junctions. It was also confirmed that the grain boundary phase contained (R',HR)—Fe(Co)-$M_1$ phase and (R',HR) rich phase while (R',HR) oxide phase segregated mainly at grain boundary triple junctions.

Figure 2A:
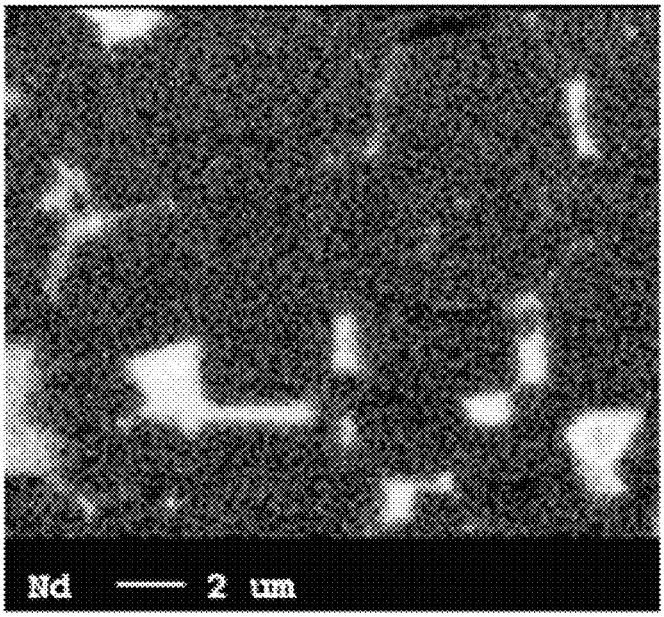
FIGS. 2A and 2B are images showing the distribution of Nd and Tb at a level of 200 μm inside the diffusion surface of the sintered magnet in Comparative Example 2, as observed by EPMA, respectively.
Figure 2B:
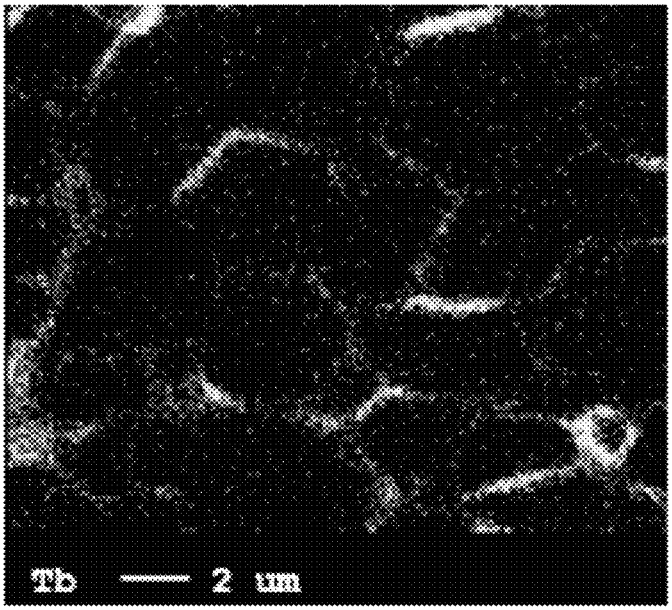

FIGS. 2A and 2B are images showing the distribution of Nd and Tb at a level of 200 μm inside the diffusion surface of the sintered magnet in Comparative Example 2, as observed by EPMA, respectively. It is seen that Tb has diffused via the grain boundary phase whereby HR rich phase is formed in a surface portion of the main phase, but HR rich phase is formed uniformly in a surface portion of the main phase.

In the images showing the distribution of Tb element, the distinction between HR rich phase and (R',HR) rich phase and (R',HR) oxide phase is vague. With a focus on the image showing the distribution of Nd element, the Nd content is high in the (R',HR) rich phase and (R',HR) oxide phase, and low in the HR rich phase, as compared with the center of the main phase, enabling the distinction therebetween. In cross-section of the R—Fe—B sintered magnets of Examples and Comparative Examples, a portion having a Nd content which is up to 80% of the Nd content at the main phase center is designated HR rich phase, and the area of that portion relative to the overall area of the main phase is calculated and reported in Table 2. As compared with the sintered magnets of Comparative Examples, the sintered magnets of Examples have a high areal proportion of HR rich phase, indicating that this R—Fe—B base sintered magnet has a high coercivity.

Examples 7 to 9 & Comparative Example 4

The sintered body obtained in Reference Example 2 was machined into a parallelepiped block of 20 mm×20 mm×2.2 mm. It was immersed in a slurry of terbium oxide particles with an average particle size of 0.5 μm in ethanol at a weight fraction of 50%, and dried, forming a coating of terbium oxide on the surface of the sintered body. The thus coated sintered body was subjected to high-temperature heat treatment including heating in vacuum at the holding temperature for the holding time shown in Table 2, and then cooling down to 200° C. at the cooling rate shown in Table 2. Thereafter, the sintered body was subjected to low-temperature heat treatment including heating at the holding temperature shown in Table 2 for 2 hours, and then cooling down to 200° C. at the cooling rate shown in Table 2, yielding a sintered magnet. The composition of this sintered magnet is shown in Table 1 and its magnetic properties are shown in Table 2. It is noted that a parallelepiped block of 6 mm×6 mm×2 mm was cut out of the sintered magnet at the center and evaluated for magnetic properties. The proportion of HR rich phase calculated as above is also reported in Table 2. As compared with the sintered magnet of Comparative Example, the sintered magnets of Examples have a high areal proportion of HR rich phase, indicating that these R—Fe—B base sintered magnets have a high coercivity.

Example 10 & Comparative Example 5

The sintered body obtained in Reference Example 1 was machined into a parallelepiped block of 20 mm×20 mm×2.2 mm. It was immersed in a slurry of dysprosium oxide particles with an average particle size of 0.5 μm in ethanol at a weight fraction of 50%, and dried, forming a coating of dysprosium oxide on the surface of the sintered body. The thus coated sintered body was subjected to high-temperature heat treatment including heating in vacuum at the holding temperature for the holding time shown in Table 2, and then cooling down to 200° C. at the cooling rate shown in Table 2. Thereafter, the sintered body was subjected to low-temperature heat treatment including heating at the holding temperature shown in Table 2 for 2 hours, and then cooling down to 200° C. at the cooling rate shown in Table 2, yielding a sintered magnet. The composition of this sintered magnet is shown in Table 1 and its magnetic properties are shown in Table 2. It is noted that a parallelepiped block of 6 mm×6 mm×2 mm was cut out of the sintered magnet at the center and evaluated for magnetic properties. The proportion of HR rich phase calculated as above is also reported in Table 2. As compared with the sintered magnet of Comparative Example, the sintered magnet of Example has a high areal proportion of HR rich phase, indicating that this R—Fe—B base sintered magnet has a high coercivity.

TABLE 1

| (at %) | | Nd | Pr | Dy | Tb | Fe | Co | B | Al | Cu | Zr | Si | Ga | O | N | C |
|---|---|---|---|---|---|---|---|---|---|---|---|---|---|---|---|---|
| Reference | 1 | 11.6 | 2.9 | — | — | bal. | 0.5 | 5.4 | 0.3 | 0.3 | 0.07 | 0.1 | 0.7 | 0.77 | 0.09 | 0.30 |
| Example | 2 | 11.6 | 3.0 | — | — | bal. | 0.5 | 5.4 | 0.3 | 0.7 | 0.14 | 0.1 | 0.7 | 0.56 | 0.09 | 0.31 |
| Example | 1 | 11.4 | 2.8 | — | 0.2 | bal. | 0.5 | 5.4 | 0.3 | 0.5 | 0.07 | 0.1 | 0.7 | 0.74 | 0.09 | 0.30 |
| | 2 | 11.3 | 2.8 | — | 0.3 | bal. | 0.5 | 5.4 | 0.3 | 0.5 | 0.07 | 0.1 | 0.7 | 0.72 | 0.09 | 0.32 |
| | 3 | 11.3 | 2.8 | — | 0.3 | bal. | 0.5 | 5.4 | 0.3 | 0.5 | 0.07 | 0.1 | 0.7 | 0.70 | 0.10 | 0.34 |
| | 4 | 11.3 | 2.8 | — | 0.3 | bal. | 0.5 | 5.4 | 0.3 | 0.5 | 0.07 | 0.1 | 0.7 | 0.72 | 0.09 | 0.33 |
| | 5 | 11.3 | 2.8 | — | 0.3 | bal. | 0.5 | 5.4 | 0.3 | 0.5 | 0.07 | 0.1 | 0.7 | 0.75 | 0.10 | 0.32 |
| | 6 | 11.3 | 2.8 | — | 0.3 | bal. | 0.5 | 5.4 | 0.3 | 0.5 | 0.07 | 0.1 | 0.7 | 0.71 | 0.09 | 0.31 |
| Comparative | 1 | 11.4 | 2.8 | — | 0.2 | bal. | 0.5 | 5.4 | 0.3 | 0.5 | 0.07 | 0.1 | 0.7 | 0.75 | 0.09 | 0.32 |
| Example | 2 | 11.4 | 2.8 | — | 0.2 | bal. | 0.5 | 5.4 | 0.3 | 0.5 | 0.07 | 0.1 | 0.7 | 0.74 | 0.09 | 0.30 |
| | 3 | 11.4 | 2.8 | — | 0.2 | bal. | 0.5 | 5.4 | 0.3 | 0.5 | 0.07 | 0.1 | 0.7 | 0.75 | 0.09 | 0.30 |
| Example | 7 | 11.5 | 2.9 | — | 0.2 | bal. | 0.5 | 5.4 | 0.3 | 0.7 | 0.14 | 0.1 | 0.7 | 0.58 | 0.10 | 0.30 |
| | 8 | 11.4 | 2.9 | — | 0.3 | bal. | 0.5 | 5.4 | 0.3 | 0.7 | 0.14 | 0.1 | 0.7 | 0.60 | 0.10 | 0.32 |
| | 9 | 11.4 | 2.9 | — | 0.3 | bal. | 0.5 | 5.4 | 0.3 | 0.7 | 0.14 | 0.1 | 0.7 | 0.57 | 0.10 | 0.31 |
| Comparative Example | 4 | 11.5 | 2.9 | — | 0.2 | bal. | 0.5 | 5.4 | 0.3 | 0.7 | 0.14 | 0.1 | 0.7 | 0.57 | 0.10 | 0.31 |
| Example | 10 | 11.4 | 2.8 | 0.2 | — | bal. | 0.5 | 5.4 | 0.3 | 0.5 | 0.07 | 0.1 | 0.7 | 0.76 | 0.09 | 0.30 |
| Comparative Example | 5 | 11.4 | 2.8 | 0.2 | — | bal. | 0.5 | 5.4 | 0.3 | 0.5 | 0.07 | 0.1 | 0.7 | 0.74 | 0.09 | 0.31 |

TABLE 2

| | | High-temperature heat treatment | | | Low-temperature heat treatment | | | | Proportion |
|---|---|---|---|---|---|---|---|---|---|
| | | Holding temp. (° C.) | Holding time (hr) | Cooling rate (° C./min) | Holding temp. (° C.) | Cooling rate (° C./min) | Br (kG) | Hcj (kOe) | of HR rich phase (%) |
| Reference Example | 1 | — | — | — | — | — | 13.5 | 18.8 | — |
| | 2 | — | — | — | — | — | 13.3 | 19.4 | — |
| Example | 1 | 975 | 5 | 20 | 450 | 20 | 13.4 | 26.2 | 4.9 |
| | 2 | 1,000 | 5 | 20 | 450 | 20 | 13.4 | 26.5 | 7.0 |
| | 3 | 1,025 | 5 | 20 | 450 | 20 | 13.3 | 26.3 | 8.3 |
| | 4 | 1,000 | 2 | 20 | 450 | 20 | 13.4 | 26.2 | 6.8 |
| | 5 | 1,000 | 10 | 20 | 450 | 20 | 13.4 | 26.4 | 7.3 |
| | 6 | 1,000 | 5 | 20 | 530 | 20 | 13.3 | 26.3 | 6.8 |
| Comparative Example | 1 | 850 | 10 | 20 | 450 | 20 | 13.5 | 22.3 | 0.8 |
| | 2 | 900 | 10 | 20 | 450 | 20 | 13.5 | 23.6 | 1.5 |
| | 3 | 900 | 10 | 20 | 530 | 20 | 13.4 | 23.4 | 1.3 |
| Example | 7 | 975 | 5 | 20 | 450 | 20 | 13.2 | 27.0 | 5.5 |
| | 8 | 1,000 | 5 | 20 | 450 | 20 | 13.2 | 27.3 | 7.6 |
| | 9 | 1,025 | 5 | 20 | 450 | 20 | 13.2 | 27.0 | 8.8 |
| Comparative Example | 4 | 900 | 10 | 20 | 450 | 20 | 13.3 | 24.0 | 1.8 |
| Example | 10 | 975 | 5 | 20 | 450 | 20 | 13.4 | 22.4 | 4.5 |
| Comparative Example | 5 | 900 | 10 | 20 | 450 | 20 | 13.4 | 21.7 | 1.2 |

Japanese Patent Application No. 2016-187177 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A method for preparing an R—Fe—B based sintered magnet, consisting of the steps of:

providing an alloy fine powder having a composition consisting essentially of 12 to 17 at % of R which is Nd and optionally contains at least one element selected from Y, Pr, La, Ce, Gd, Dy, Tb, and Ho, 0.1 to 3 at % of $M_1$ which is at least one element selected from the group consisting of Si, Al, Mn, Ni, Cu, Zn, Ga, Ge, Pd, Ag, Cd, In, Sn, Sb, Pt, Au, Hg, Pb, and Bi, 0.05 to 0.5 at % of $M_2$ which is at least one element selected from the group consisting of Ti, V, Cr, Zr, Nb, Mo, Hf, Ta, and W, 4.8+2×m to 5.9+2×m at % of boron wherein m is at % of $M_2$, up to 10 at % of Co, up to 0.5 at % of carbon, up to 1.5 at % of oxygen, up to 0.5 at % of nitrogen, and the balance of Fe, (a) compression shaping the alloy fine powder in an applied magnetic field into a compact, (b) sintering the compact at a temperature of 900 to 1,250° C. into a sintered body, (c) cooling the sintered body to a temperature of up to 400° C., (d) performing a high-temperature heat treatment for diffusion including placing a metal compound or intermetallic compound containing heavy rare earth element (HR) which is at least one element selected from Dy, Tb and Ho, on the surface of the sintered body, heating at a temperature that is in a range of from more than 950° C. to 1,100° C., for causing grain boundary diffusion of HR into the sintered body from the metal compound or intermetallic compound containing HR placed on the surface of the sintered body, and cooling to a temperature of 200 to 400° C., and (e) immediately upon cooling to the temperature of 200 to 400° C. in step (d), performing a low-temperature heat treatment for diffusion including heating at a temperature of 400 to 600° C. and cooling to a temperature of up to 300° C. at a cooling rate of 1 to 100° C./min until an upper limit of the temperature range is reached, so as to form the R—Fe—B based sintered magnet having a grain boundary phase comprising a (R',HR)—Fe(Co)-$M_1$ phase, wherein R' in the (R',HR)—Fe(Co)-$M_1$ phase is at least one element selected from the group consisting of rare earth elements excluding Dy, Tb, and Ho.

2. The method according to claim 1, wherein, in the step (d), heating rate is 1 to 20° C./min, and holding time for the high-temperature heat treatment for diffusion is 0.5 to 50 hours.

3. The method according to claim 1, wherein, in the step (d), cooling rate is 1 to 100° C./min until an upper limit of the temperature range is reached.

4. The method according to claim 1, wherein, in the step (e), heating rate is 1 to 20° C./min, and holding time for the low-temperature heat treatment is 0.5 to 50 hours.

5. The method according to claim 1, wherein $M_2$ is at least one element selected from V, Cr, Zr, Nb, Mo, Hf, Ta, and W.

6. The method according to claim 1, wherein the step (d) comprises heating the sintered body at a temperature in a range of from 960° C. to 1,100° C.

7. The method according to claim 1, wherein the step (d) comprises heating the sintered body at a temperature in a range of from 975° C. to 1,100° C.

8. The method according to claim 1, wherein after the step (c), the step (d) comprises heating the sintered body to said temperature at a heating rate of 1 to 20° C. per minute.

9. The method according to claim 1, wherein the step (d) is performed immediately after the step (c).

10. The method according to claim 1, wherein $M_1$ in the (R',HR)—Fe(Co)-$M_1$ phase consists of:

(1) 0.5 to 50 at % of Si and the balance being at least one element selected from the group consisting of Al, Mn, Ni, Cu, Zn, Ga, Ge, Pd, Ag, Cd, In, Sn, Sb, Pt, Au, Hg, Pb, and Bi, or (2) 1.0 to 80 at % of Ga and the balance being at least one element selected from the group consisting of Si, Al, Mn, Ni, Cu, Zn, Ge, Pd, Ag, Cd, In, Sn, Sb, Pt, Au, Hg, Pb, and Bi, or (3) 0.5 to 50 at % of Al and the balance being at least one element selected from the group consisting of Si, Mn, Ni, Cu, Zn, Ga, Ge, Pd, Ag, Cd, In, Sn, Sb, Pt, Au, Hg, Pb, and Bi.

11. A method for preparing an R—Fe—B based sintered magnet, comprising the steps of:

providing an alloy fine powder having a composition consisting essentially of 12 to 17 at % of R which is Nd and optionally contains at least one element selected from Y, Pr, La, Ce, Gd, Dy, Tb, and Ho, 0.1 to 3 at % of $M_1$ which is at least one element selected from the group consisting of Si, Al, Mn, Ni, Cu, Zn, Ga, Ge, Pd, Ag, Cd, In, Sn, Sb, Pt, Au, Hg, Pb, and Bi, 0.05 to 0.5 at % of $M_2$ which is at least one element selected from the group consisting of Ti, V, Cr, Zr, Nb, Mo, Hf, Ta, and W, 4.8+2×m to 5.9+2×m at % of boron wherein m is at % of $M_2$, up to 10 at % of Co, up to 0.5 at % of carbon, up to 1.5 at % of oxygen, up to 0.5 at % of nitrogen, and the balance of Fe, (a) compression shaping the alloy fine powder in an applied magnetic field into a compact, (b) sintering the compact at a temperature of 900 to 1,250° C. into a sintered body, (c) cooling the sintered body to a temperature of up to 400° C., (f) after step (c) and prior to step (d), the sintered body is subjected to two stages of heat treatment, wherein the two stages consist of:

(f)(1) high-temperature heat treatment for the sintered body, including heating at a temperature of 700° C. to 1,100° C., and cooling to a temperature of up to 400° C., and (f)(2) low-temperature heat treatment subsequent to the high-temperature heat treatment for the sintered body, including heating at a temperature of 400° C. to 600° C., and cooling to a temperature of up to 300° C., (d) performing a high-temperature heat treatment for diffusion including placing a metal compound or intermetallic compound containing heavy rare earth element (HR) which is at least one element selected from Dy, Tb and Ho, on the surface of the sintered body, heating at a temperature that is in a range of from more than 950° C. to 1,100° C. for causing grain boundary diffusion of HR into the sintered body from the metal compound or intermetallic compound containing HR placed on the surface of the sintered body, and cooling to a temperature of 200 to 400° C., and (e) immediately upon cooling the sintered body to the temperature of 200 to 400° C. in step (d), performing a low-temperature heat treatment for diffusion including heating at a temperature of 400 to 600° C. and cooling to a temperature of up to 300° C., so as to form the R—Fe—B based sintered magnet having a grain boundary phase comprising a (R',HR)—Fe(Co)-$M_1$ phase, wherein R' in the (R',HR)—Fe(Co)-$M_1$ phase is at least one element selected from the group consisting of rare earth elements excluding Dy, Tb, and Ho.

12. The method according to claim 11, wherein in the step (f)(1), heating rate is 1 to 20° C./min, and holding time for the high-temperature heat treatment is 1 to 10 hours.

13. The method according to claim 11, wherein, in the step (f)(1), cooling rate is 1 to 100° C./min until an upper limit of the temperature range is reached.

14. The method according to claim 11, wherein, in the step (f)(2), heating rate is 1 to 20° C./min, and holding time for the low-temperature heat treatment is 0.5 to 50 hours.

15. The method according to claim 11, wherein, in the step (f)(2), cooling rate is 1 to 100° C./min until an upper limit of the temperature range is reached.

16. The method according to claim 11, wherein in the step (c), the sintered body is cooled to a temperature of up to 300° C., and after the step (c), the step (d) comprises heating the sintered body to said temperature at a heating rate of 1 to 20° C. per minute.

17. The method according to claim 11, wherein, in the step (d), heating rate is 1 to 20° C./min, and holding time for the high-temperature heat treatment for diffusion is 0.5 to 50 hours.

18. The method according to claim 11, wherein, in the step (d), cooling rate is 1 to 100° C./min until an upper limit of the temperature range is reached.

19. The method according to claim 11, wherein, in the step (e), heating rate is 1 to 20° C./min, and holding time for the low-temperature heat treatment is 0.5 to 50 hours.

20. The method according to claim 11, wherein, in the step (e), cooling rate is 1 to 100° C./min until an upper limit of the temperature range is reached.

21. The method according to claim 11, wherein $M_2$ is at least one element selected from V, Cr, Zr, Nb, Mo, Hf, Ta, and W.

22. The method according to claim 11, wherein the step (d) comprises heating the sintered body at a temperature in a range of from 960° C. to 1,100° C.

23. The method according to claim 11, wherein the step (d) comprises heating the sintered body at a temperature in a range of from 975° C. to 1,100° C.

24. The method according to claim 11, wherein after the step (c), the step (d) comprises heating the sintered body to said temperature at a heating rate of 1 to 20° C. per minute.

25. The method according to claim 11, wherein the step (d) is performed immediately after the step (c).

26. The method according to claim 11, wherein $M_1$ in the (R',HR)—Fe(Co)-$M_1$ phase consists of:

(1) 0.5 to 50 at % of Si and the balance being at least one element selected from the group consisting of Al, Mn, Ni, Cu, Zn, Ga, Ge, Pd, Ag, Cd, In, Sn, Sb, Pt, Au, Hg, Pb, and Bi, or (2) 1.0 to 80 at % of Ga and the balance being at least one element selected from the group consisting of Si, Al, Mn, Ni, Cu, Zn, Ge, Pd, Ag, Cd, In, Sn, Sb, Pt, Au, Hg, Pb, and Bi, or (3) 0.5 to 50 at % of Al and the balance being at least one element selected from the group consisting of Si, Mn, Ni, Cu, Zn, Ga, Ge, Pd, Ag, Cd, In, Sn, Sb, Pt, Au, Hg, Pb, and Bi.

* * * * *